US007226240B2

(12) United States Patent
Tyler

(10) Patent No.: US 7,226,240 B2
(45) Date of Patent: Jun. 5, 2007

(54) DEVICES, SYSTEMS, AND METHODS FOR CONTROLLING EROSION

(76) Inventor: Rodney W. Tyler, 4424 Coddingville Rd., Medina, OH (US) 44256

( * ) Notice: Subject to any disclaimer, the term of this patent is extended or adjusted under 35 U.S.C. 154(b) by 622 days.

(21) Appl. No.: 10/208,631

(22) Filed: Jul. 29, 2002

(65) Prior Publication Data

US 2003/0031511 A1 Feb. 13, 2003

Related U.S. Application Data

(60) Provisional application No. 60/309,054, filed on Jul. 31, 2001.

(51) Int. Cl.
*E02B 3/12* (2006.01)
*E02D 3/00* (2006.01)
*C02F 1/00* (2006.01)

(52) U.S. Cl. ..... 405/19; 405/302.4; 210/170.03

(58) Field of Classification Search ..... 405/107, 405/111, 114, 115, 302.4, 302; 210/170, 210/242; 53/459, 469, 479, 417, 418, 576, 53/138.2, 138.3, 138.4, 138.5, 138.7, 138.8, 53/567

See application file for complete search history.

(56) References Cited

U.S. PATENT DOCUMENTS 2,201,279 A 5/1940 Willing
2,842,897 A 7/1958 Finn
3,617,566 A 11/1971 Oshima et al.
3,979,146 A * 9/1976 Berg ..... 209/418
5,015,123 A 5/1991 Houck et al.
5,030,031 A * 7/1991 Brown ..... 405/107
5,310,288 A 5/1994 Huang
5,405,217 A 4/1995 Dias et al.
5,519,985 A 5/1996 Dyck et al.
5,595,458 A 1/1997 Grabhorn
5,605,416 A 2/1997 Roach
5,658,096 A 8/1997 Von Kanel
5,678,954 A 10/1997 Bestmann
5,679,247 A 10/1997 Burke (Continued)

OTHER PUBLICATIONS

Albright Seed Company; "Construction Site Erosion. . . "; Streamline Publications, 1997, (pp. 1-3).*

(Continued)

*Primary Examiner*—Michael Safavi
(74) *Attorney, Agent, or Firm*—Michael Haynes, PLC; Michael N. Haynes

(57) ABSTRACT

Included in the disclosure are exemplary devices, systems, and methods, embodiments of some of which can be useful for controlling erosion, retaining sediment, preventing siltation, treating runoff, removing pollutants, remediating environmental damage, protecting plants, establishing vegetation, protecting ecosystems, and/or restoring waterways and/or other riparian areas. At least one exemplary device includes a tubular mesh enclosure formed from a mesh material having a nominal opening size of less than 0.5 inches, a ratio of a length of the mesh enclosure to a diameter of the mesh enclosure greater than 40, having an opposing pair of ends, at least one of said ends sealed, said enclosure surrounding a filling. It is emphasized that this abstract is provided to comply with the rules requiring an abstract that will allow a searcher or other reader to quickly ascertain the subject matter of the technical disclosure. This abstract is submitted with the understanding that it will not be used to interpret or limit the scope or meaning of the claims.

86 Claims, 2 Drawing Sheets

U.S. PATENT DOCUMENTS

| | | | | |
|---|---|---|---|---|
| 5,747,633 | A * | 5/1998 | Ito et al. | 528/272 |
| 5,854,304 | A * | 12/1998 | Garcia et al. | 523/124 |
| 6,085,810 | A | 7/2000 | Castillo et al. | |
| 6,109,835 | A | 8/2000 | Grabhorn | |
| 2002/0146394 | A1 | 10/2002 | Stamets | |

OTHER PUBLICATIONS

Carla Huffman, Harry Weekes, Mimi Wallace, and Nancy Wright, "Phytoremdiation", 1998, published by WWLPT Biology Institute, at [http://www.woodrow.org/teachers/bi/1998/bioremediation/].

David Glass, Ph.D., "U.S. and International Markets for Phytoremediation, 1999-2000", 1999, D. Glass Associates, Inc. at [http://www.channel1.com/dglassassoc/INFO/phy99exc.htm].

Steve Bentjen, "Bioremediation and Phytoremediation Glossary", 1998 at [http://members.tripod.com/~bioremediation/].

"Phytoremediation", Review Articles, 2001 at [http://www.mobot.org/jwcross/phytoremediation/phytorem_reviews.htm]; Jan. 6, 2001.

"Erosion Control", 2001, California Integrated Waste Management Board, at [http://www.ciwmb.ca.gov/Organics/Erosion/]; Jun. 13, 2001.

Janis Keating, "Compost Coverage", Erosion Control, May/Jun. 2001, pp. 30-35.

Rod Tyler, "Compost's Next Wave", Waste Age, May 2002, p. 34.

Janis Keating, "Seeding: Success is all in the Techniques", Erosion Control, Jan./Feb. 2002, pp. 46, 48-52.

Land and Water, The Magazine of National Resource Management and Restoration, Mar./Apr. 2002, pp. 1-72, Land and Water, Fort Dodge, IA.

* cited by examiner

DEVICES, SYSTEMS, AND METHODS FOR CONTROLLING EROSION

This application claims priority to, and incorporates herein by reference in its entirety, pending U.S. Provisional Patent Application Ser. No. 60/309,054, titled "Device, System, and Method for Controlling Erosion", filed 31 Jul. 2001.

BRIEF DESCRIPTION OF THE DRAWINGS

Certain embodiments of the invention will be more readily understood through the following detailed description, with reference to the accompanying drawings, in which.

DETAILED DESCRIPTION

The present invention generally relates to devices, systems, and methods, embodiments of some of which can be useful for controlling erosion, retaining sediment, preventing siltation, treating runoff, removing pollutants, remediating environmental damage, protecting plants, bordering play areas, absorbing spills, establishing vegetation, protecting ecosystems, and/or restoring waterways and/or other riparian areas.

Certain exemplary embodiments of the present invention include a system that can include mesh tubes and/or enclosures that are filled with any of a variety of materials, including compost, composted products, mulch, sawdust, soil, gravel, and/or various other organic and/or inorganic substances. Such filled tubes can be filled on-site, which can reduce the transportation cost of the systems. Moreover, such filled tubes can be relatively heavy, thereby avoiding floating away in heavy rain.

Certain embodiments of such filled tubes can be used in a variety of ways such as on an erosion-prone slope, across a small drainage ditch, or surrounding a drain. The tubes can be held in place by their own weight and/or by stakes, which can be driven through the tubes and into the ground. In certain embodiments, attached to the tubes can be additional anchoring mesh, through which anchors can be driven to secure the tubes to the ground.

Certain exemplary embodiments of the present invention include a method for filling and placing the compost-filed tubes on-site. The tubes can be filled using a pneumatic blower truck, an auger, and/or by hand.

System 1000

Figure 1:
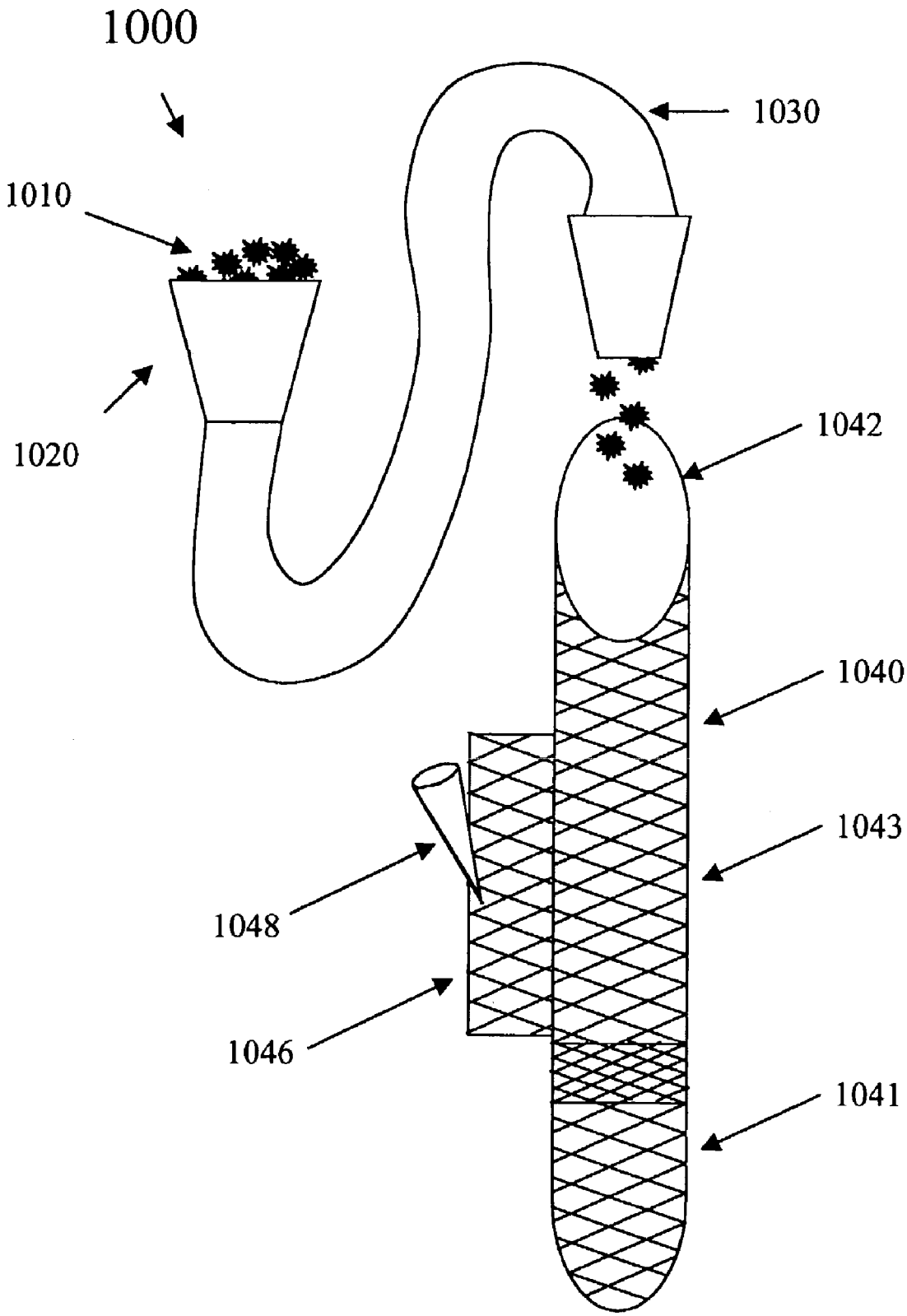
FIG. 1 is a block diagram of an embodiment of a system 1000 of the present invention.
Figure 2:
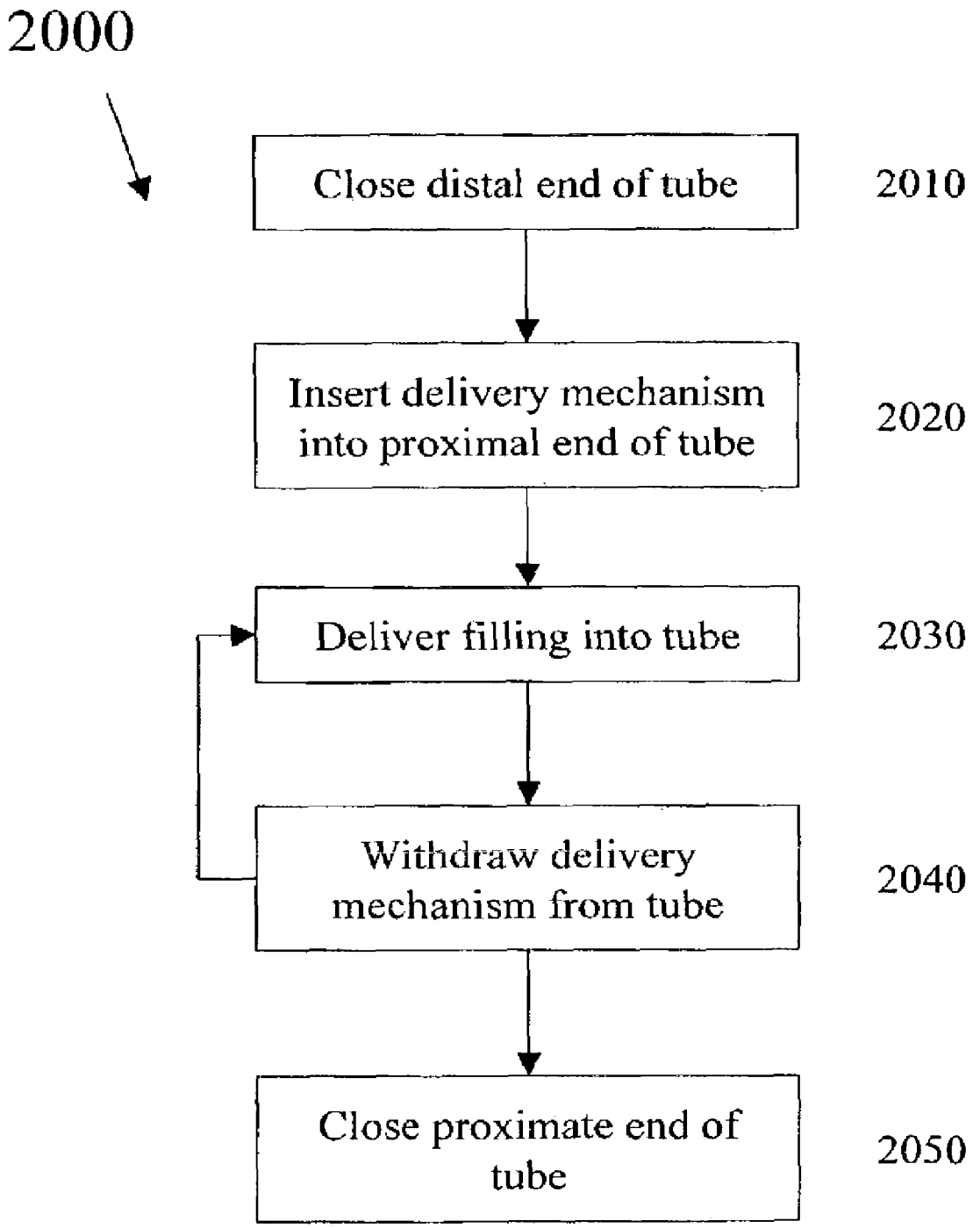
FIG. 2 is a flowchart of an embodiment of a method 2000 of the present invention.

FIG. 1 is a block diagram of an exemplary embodiment of a system 1000 of the present invention. System 1000 can include a filling 1010, which can be contained in a storage enclosure 1020 and delivered via a delivery mechanism 1030 to a mesh tube 1040.

Filling 1010 can include any of a number of materials, including compost, composted organic materials, organic feedstocks, composted products, mulch, wood shavings, alum, lime, clay, pea gravel, gravel, sand, soil, wood chips, bark, peat, soil blends, straw, hay, leaves, sawdust, paper mill residuals, wood wastes, wood pellets, hemp, bamboo, biosolids, coconut fibers, coir, wheat straw, rice straw, rice hulls, oat straw, soybean hulls, palm wastes, palm leaves, agricultural waste products, manure, wool, hair, sugar cane bagasse, seed hulls, jute, flax, hulls, organic waste, cat litter, plant seeds, plugs, sprigs, and/or spores, etc.

Certain embodiments of filling 1010, such as compost, can provide treatment of runoff water by physically straining the runoff; biologically degrading unwanted, harmful, and/or polluting substances; and/or chemically binding certain pollutants, such as metals (e.g., arsenic, cadmium, chromium, cobalt, copper, lead, mercury, nickel, and/or selenium), hydrocarbons and/or organic chemicals (such as 2,4,6-trinitrotoluene), and/or nutrients (such as fertilizer, nitrates, phosphates, sewage, and/or animal waste).

Certain embodiments of filling 1010, such as compost, can be weed seed-free, disease-free, and/or insect-free, and can be derived from a well-decomposed source of organic matter. Certain embodiments of such compost can be free of refuse, contaminants, and/or other materials toxic and/or deleterious to plant growth. In certain embodiments, the compost can have a pH that measures anywhere between approximately 5.0 and approximately 8.0. Certain embodiments of such compost can be produced according to an aerobic composting process meeting 40 CFR 503 regulations. Certain embodiments of such compost can have a moisture content of less than 60%.

In certain embodiments, such as perhaps those involving water filtration, the particle size of the compost can conform to the following: 99% passing a 1 inch sieve, 90% passing a 0.75 inch sieve, a minimum of 70% greater than a 0.375 inch sieve, and/or less than 2% exceeding 3 inches in length.

In certain embodiments, such as those use for creating a plant growing environment, the minimum particle size can be eliminated, thereby effectively ensuring that some fines will remain that can help vegetation become established.

Certain embodiments of such compost, such as those used for sediment control, can contain less than 1% by dry weight of inert, foreign, and/or man-made materials. Certain embodiments of such compost can have predetermined materials added thereto.

For example, certain embodiments of filling 1010 can include, support, and/or encompass one or more microorganisms, microflora, rhizospheres, mycospheres, and/or ecosystems that can biologically and/or chemically breakdown, decompose, degrade, bind, and/or filter unwanted pollutants in the water that flows therethrough.

Certain embodiments of filling 1010 can include entities such as colonies, spores, seeds, bulbs, plugs, sprouts, sprigs, and/or seedlings of microorganisms, bacteria, fungi, and/or plants. As these entities become established, these entities can provide numerous beneficial functions.

For example, certain living entities can assist with remediating the environmental impact of the expected effluent. For example, plants commonly called cattails, reeds, rushes and/or skunk cabbage can be useful for treating certain types of sewage. Thus, for example, a potential wetland area downstream of a septic field could be surrounded and/or filled with a filled tubes seeded with an appropriate variety of plant.

As another example, certain plants, such as mustard, can be useful for absorbing particular heavy metals. As yet another example, the root systems of plants growing from a filled tube can serve to anchor the filled tube into the adjacent soil. This anchoring can serve to prevent run-off from moving or washing away the filled tube.

As a further example, certain embodiments of the filled mesh tube can eventually provide plants can improve the aesthetic image of the filled tube. Thus, rather than permanently presenting a black, brown, or gray-colored compost-filled tube, a sprouted filled tube can present, for example, blooming flowers, groundcovers, vines, shrubs, grasses (such as turn seed, annual rye, crown vetch, birds foot trefoil, and/or fescues), and/or aquatic plants, etc.

As another example, via a technique called mycoremediation, certain fungi and/or fungal components, such as macrofungi (including mushrooms commonly referred to as shiitakes, portabellas, criminis, oysters, whites, and/or morels), white-rot fungi (such as *P. chrysosporium*), brown-rot fungi, mycelium, mycelial hyphae, and/or conidia, can be useful for decomposing and/or breaking down pollutants and/or contaminants, including petroleum, fertilizers, pesticides, explosives, and/or a wide assortment of agricultural, medical, and/or industrial wastes. Certain of such fungi and/or fungal components are available from Fungi Perfecti of Olympia, Wash.

In certain embodiments, a microbial community encompassed within the filling of the mesh tube can participate with the fungi and/or fungal components to break down certain contaminants to carbon dioxide and water. Certain wood-degrading fungi can be effective in breaking down aromatic pollutants and/or chlorinated compounds. They also can be natural predators and competitors of microorganisms such as bacteria, nematodes, and/or rotifers. Certain strains of fungi have been developed that can detect, attack, destroy, and/or inhibit the growth of particular bacterial contaminants, such as *Escherichia coli* (*E. coli*).

Certain embodiments of the filling can include one or more fertilizers, flocculants, chemical binders, and/or water absorbers, any of which can be selected to address a particular need and/or problem, such as to fertilize the growth of a predetermined plant species and/or to bind a predetermined chemical.

Storage enclosure 1020 can at least partially surround filling 1010, and can be a vessel, tank, hopper, truck, and/or pile, etc. Delivery mechanism 1030 can be a hose, tube, pipe, duct, and/or chute, and can include a mechanical and/or pneumatic component, such as an auger, vibrator, and/or fan, etc. for biasing filling 1010 toward and/or into mesh tube 1040. Moreover, delivery mechanism 1030 can be replaced with a manual approach, whereby a human places filling 1010 into mesh tube 1040. Delivery mechanism 1030 can include a nozzle, reducer, and/or hose adaptor that allows a standard hose (such as a hose having an approximately 4 or 5 inch diameter) to fill a larger and/or smaller diameter mesh tube.

Mesh tube 1040 can be fabricated from a flexible netting material, which can be woven, sewn, knitted, welded, molded, and/or extruded, etc. One source of netting material is Tipper Tie-net of West Chicago, Ill. The netting material can be biodegradable, and in certain embodiments, at a predetermined rate of biodegradation. Alternatively, the netting material can resist biodegradation. The netting material can be fabricated from cotton, burlap, hemp, plastic, biodegradable plastic, UV sensitive plastic, UV inhibited plastic, polyester, polypropylene, multi-filament polypropylene, polyethylene, LDPE, HDPE, rayon, and/or nylon.

The netting material can be of any diameter and/or thickness, ranging from approximately 0.5 mils to 30 mils, including approximately 0.5, 0.75, 1, 2, 3, 4, 5, 6, 7, 8, 9, 10, 12, 15, 18, 20, 22, 25, 28, and/or 30 mils. The netting material can be in any available mesh size (mesh opening), from a mesh as small as that of women's pantyhose, and including a nominal mesh opening of approximately: 0.001, 0.005, 0.010, 0.025, 0.050, 0.0625, 0.125, 0.25, 0.375, 0.5, 0.625, 0.75, 0.875, 1.0, 1.125, 1.25, 1.375, and/or 1.5 inches. The netting material can have any mesh opening pattern, including diamond, hexagonal, oval, round, and/or square, etc. Mesh tube 1040 can be fabricated in standard lengths, such as any of approximately 1, 2, 3, 4, 5, 6, 7, 8, 9, 10, 15, 20, 25, 50, 75, 100, 125, 150, 200, 250, 300, 400, and/or 500 foot lengths, any of which can be coupled together to form a continuous mesh tube of any size, including tubes as long as 1000, 2000, 3000, 4000, 5000, 7500, and/or 10,000 or more feet. Therefore, in certain exemplary embodiments, mesh tube 1040 can comprise a first tubular mesh enclosure 1041 and a second tubular mesh enclosure 1043. Thus, certain lengths of filled mesh tubes can be intended to be portable, and other lengths of filled mesh tubes can be intended to be immobile.

Mesh tube 1040 can be filled completely or incompletely. When filled completely, mesh tube 1040 can be generally curvilinear, round, oval, or polygonal in longitudinal cross-section. If generally oval, mesh tube 1040 can have a major diameter ranging from approximately 3 inches to approximately 30 inches, including approximately 3, 4, 5, 6, 8, 10, 12, 14, 16, 18, 20, 22, 24, 26, 28, and/or 30 inches. Thus, the ratio of the length of mesh tube 1040 to its major diameter can be approximately 5, 6, 7, 8, 9, 10, 15, 20, 25, 30, 35, 40, 45, 50, 75, 100, 150, 200, 300, 400, and/or 500 or larger.

Mesh tube 1040 can have opposing longitudinal ends, the end nearest the delivery device called the proximal end 1042 and the end furthest the delivery device called the distal end 1044. Distal end 1044 can be closed and/or sealed prior to the delivery of filling 1010 into mesh tube 1040. After delivery of filling 1010 into mesh tube 1040, proximal end 1042 can be closed and/or sealed. The method of closing and/or sealing either of ends 1042, 1044 can include knitting, sewing, folding, welding, stapling, clipping, clamping, tying, knotting, and/or fastening, etc.

Attached to mesh tube 1040 can be an anchoring device 1046, such as a flap fabricated from mesh netting, such as that used to fabricate mesh tube 1040. Such a flap can range in dimensions with the size of the tube and/or the expected forces that might bear upon the tube. For example, an 8-inch diameter tube might have two 4 inch wide flaps that are made from the same mesh material as the tube, and that extend along the entire length of the tube. Stakes can be driven through each of these flaps and into the underlying substrate. This can secure both sides of the tube, and can create additional stability for the tube.

Alternatively, anchoring device 1046 can be fabricated from any fabric. In another alternative embodiment, anchoring device 1046 can be a string, rope, cable tie, sod stakes, re-bar, wood stakes, and/or wire, etc. attached to mesh tube 1040.

Mesh tube 1040 can be attached to a geo-surface, such as the ground, soil, sand, silt, sod, earth, dirt, clay, mud, peat, gravel, rock, asphalt, concrete, pavement, a streambed, a stream bank, a waterway bank, a pond bank, a ditch, a ditch bank, and/or a slope, etc. The means for attaching mesh tube 1040 can include an attachment device 1048 that protrudes through mesh tube 1040 and/or anchoring device 1046. As an example, a metal or wooden stake could be hammered through a mesh-anchoring device 1046 and into a ditch bed to secure a mesh tube across the flow path of a ditch to form a "ditch check". Such a ditch check can slow water flow, encourage the deposition of silt and/or sediment, and/or potentially encourage the growth of plants whose root systems can further discourage run-off and/or erosion.

In certain embodiments, a filled mesh tube can at least partially impede the flow of water into a storm water basin inlet, thereby potentially preventing clogging of the piping that drains the basin and/or filtering the water that enters the basin.

In certain embodiments, multiple mesh tubes 1040 can be stacked, thereby forming a wall. Uphill from the tubes can be placed and/or backfilled, in some cases pneumatically, a geo-surface material and/or media, such as soil, sod, earth, dirt, clay, mud, peat, gravel, rock, and/or a filling material, as described earlier. Such a geo-surface material can be used to restore an eroded zone, such as when a stream bank has eroded beneath existing trees, exposing the trees and making them vulnerable to toppling. By installing multiple mesh tubes as a form of retaining wall, and back-filling with suitable material for supporting the tree and/or sustaining the tree's previously-exposed roots, the stream bank can be restored and the tree can potentially be saved.

Method 2000

Certain exemplary embodiments of the present invention can employ a method 2000 for forming a storm water control system, erosion control system, sediment control system, silt reduction system, soil retention system, water protection system, water filtration system, pollution remediation system, plant protection system, plant initiation system, and/or erosion remediation system.

The method can include numerous activities. For example, at activity 2010, a distal end of a mesh tube can be closed and/or sealed, such as by typing a knot in the tube. At activity 2020, a delivery mechanism, such as a blower hose or an auger outlet, can be inserted into an open proximate end of the mesh tube.

Alternatively, a mesh tube having open ends can be slid over a blower hose, and then an end of the tube can be closed and/or sealed.

At activity 2030, a filling can be discharged from the delivery mechanism into the mesh tube. The filling can be supplied to the delivery mechanism by, for example, a blower truck that contains a supply of the filling and is coupled pneumatically to the blower hose. Such blower trucks can include a pneumatic blower mounted on a portable truck that can be capable of reaching remote areas. A typical blower truck can blow filler down a hose of up to 700 feet in length, and can be obtained from Express Blower, Rexius, Finn, and/or Blotech.

As another example, a hopper can drop the filling into an auger that conveys the filling into the mesh tube. Activity 2030 can occur anywhere. That is, the mesh tube can be filled off-site ("ex-situ") and/or on-site ("in situ"), which can include at the ultimate desired location for the filled tube.

At activity 2040, the delivery mechanism can be withdrawn from the mesh tube when the mesh tube has been filled to the desired level. At activity 2050, the proximate end of the mesh tube can be closed and/or sealed. Alternatively, the filled tube can be attached to a second tube in a process called sleeving, in which one tube overlaps the other by about 2 to 4 feet, thereby effectively extending the length of the first tube. If needed, the two tubes can be attached together using, for example, twist ties, zip ties, or the like. Then the filling process can continue. Additional tubes can be further attached to form a continuous tube of any desired length.

It should be understood that the preceding is merely a detailed description of one or more exemplary embodiments of this invention and that numerous changes to the disclosed embodiments can be made in accordance with the disclosure herein without departing from the spirit or scope of the invention. The preceding description, therefore, is not meant to limit the scope of the invention. Rather, the scope of the invention is to be determined only by the appended claims, every element of which can be replaced by any one of numerous equivalent alternatives without departing from the spirit or scope of the invention, only some of which equivalent alternatives are disclosed in the specification.

What is claimed is:

1. A system comprising a first tubular mesh enclosure formed from a mesh material having a nominal opening size of less than 0.5 inches, said first tubular mesh enclosure having a first opposing pair of ends, at least one of said first opposing pair of ends sealed, said first tubular mesh enclosure defining a first length and a first generally oval cross-section defining a first major diameter, a first ratio of said first length to said first major diameter greater than approximately 40, said first tubular mesh enclosure surrounding a filling, said system further comprising a second tubular mesh enclosure attached to said first tubular mesh enclosure.

2. The system of claim 1, further comprising a means for anchoring said first tubular mesh enclosure.

3. The system of claim 1, further comprising a means for anchoring said first tubular mesh enclosure to a surface, said means for anchoring said first tubular mesh enclosure attached to said first tubular mesh enclosure.

4. The system of claim 1, further comprising an anchor flap attached to said first tubular mesh enclosure.

5. The system of claim 1, further comprising an anchor flap attached to said first tubular mesh enclosure, said anchor flap penetrable by a stake.

6. The system of claim 1, further comprising an anchor flap attached to said first tubular mesh enclosure, said anchor flap attachable to a surface via a stake.

7. The system of claim 1, further comprising an anchor flap attached to said first tubular mesh enclosure, and a anchor for securing said anchor flap to a geo-surface.

8. The system of claim 1, further comprising an anchor flap attached to said first tubular mesh enclosure, and a means for securing said anchor flap to a geo-surface.

9. The system of claim 1, further comprising an additional quantity of said filling placed against an outer surface of said first tubular mesh enclosure.

10. The system of claim 1, wherein a portion of said second tubular mesh enclosure overlaps a portion of said first tubular mesh enclosure.

11. The system of claim 1, wherein said second tubular mesh enclosure surrounds said filling.

12. The system of claim 1, wherein said second tubular mesh enclosure is formed from a mesh material having a nominal opening size of less than 0.5 inches, said second tubular mesh enclosure having a second opposing pair of ends, at least one of said second opposing pair of ends sealed, said second tubular mesh enclosure defining a second length, a second generally oval cross-section defining a second major diameter, a second ratio of said second length to said second major diameter greater than approximately 40, said second tubular mesh enclosure surrounding said filling.

13. The system of claim 1, wherein said first tubular mesh enclosure is fabricated from a material selected from cotton, plastic, biodegradable plastic, UV sensitive plastic, UV inhibited plastic, polyester, polypropylene, multi-filament polypropylene, polyethylene, LDPE, HDPE, rayon, and nylon.

14. The system of claim 1, wherein said first tubular mesh enclosure is biodegradable.

15. The system of claim 1, wherein said filling is pneumatically-provided.

16. The system of claim 1, wherein said filling is auger-provided.

17. The system of claim 1, wherein said filling is manually-provided.

18. The system of claim 1, wherein said first tubular mesh enclosure is filled at a site where said first tubular mesh enclosure is to be installed.

19. The system of claim 1, wherein said first tubular mesh enclosure is filled in situ.

20. The system of claim 1, wherein said filling includes compost.

21. The system of claim 1, wherein said filling includes composted product.

22. The system of claim 1, wherein said filling includes mulch.

23. The system of claim 1, wherein said filling includes wood shavings.

24. The system of claim 1, wherein said filling includes alum.

25. The system of claim 1, wherein said filling includes lime.

26. The system of claim 1, wherein said filling includes clay.

27. The system of claim 1, wherein said filling includes pea gravel.

28. The system of claim 1, wherein said filling includes gravel.

29. The system of claim 1, wherein said filling includes sand.

30. The system of claim 1, wherein said filling includes soil.

31. The system of claim 1, wherein said filling includes wood chips.

32. The system of claim 1, wherein said filling includes bark.

33. The system of claim 1, wherein said filling includes peat.

34. The system of claim 1, wherein said filling includes soil blends.

35. The system of claim 1, wherein said filling includes hay.

36. The system of claim 1, wherein said filling includes leaves.

37. The system of claim 1, wherein said filling includes sawdust.

38. The system of claim 1, wherein said filling includes paper mill residuals.

39. The system of claim 1, wherein said filling includes wood wastes.

40. The system of claim 1, wherein said filling includes wood pellets.

41. The system of claim 1, wherein said filling includes hemp.

42. The system of claim 1, wherein said filling includes bamboo.

43. The system of claim 1, wherein said filling includes rice hulls.

44. The system of claim 1, wherein said filling includes soybean hulls.

45. The system of claim 1, wherein said filling includes palm wastes.

46. The system of claim 1, wherein said filling includes palm leaves.

47. The system of claim 1, wherein said filling includes agricultural waste products.

48. The system of claim 1, wherein said filling includes manure.

49. The system of claim 1, wherein said filling includes wool.

50. The system of claim 1, wherein said filling includes hair.

51. The system of claim 1, wherein said filling includes sugar cane bagasse.

52. The system of claim 1, wherein said filling includes seed hulls.

53. The system of claim 1, wherein said filling includes jute.

54. The system of claim 1, wherein said filling includes flax.

55. The system of claim 1, wherein said filling includes hulls.

56. The system of claim 1, wherein said filling includes organic waste.

57. The system of claim 1, wherein said filling includes cat litter.

58. The system of claim 1, wherein said filling includes plant seeds.

59. The system of claim 1, wherein said filling includes spores.

60. The system of claim 1, wherein said filling includes at least one rhizosphere.

61. The system of claim 1, wherein said filling includes at least one colony.

62. The system of claim 1, wherein said filling includes a fungal component.

63. The system of claim 1, wherein said filling includes plugs.

64. The system of claim 1, wherein said filling includes sprigs.

65. The system of claim 1, wherein said filling includes fertilizer.

66. The system of claim 1, wherein said filling includes flocculants.

67. The system of claim 1, wherein said filling includes chemical binders.

68. The system of claim 1, wherein said filling includes a water absorbent.

69. The system of claim 1, wherein both of said ends are closed.

70. The system of claim 1, wherein said first tubular mesh enclosure is attached to the ground.

71. The system of claim 1, wherein said first tubular mesh enclosure is knitted.

72. The system of claim 1, wherein said first tubular mesh enclosure is welded.

73. The system of claim 1, wherein said first tubular mesh enclosure is extruded.

74. The system of claim 1, wherein said first tubular mesh enclosure is sewn.

75. The system of claim 1, wherein said first tubular mesh enclosure is stapled.

76. The system of claim 1, wherein said major diameter is greater than approximately 4 inches.

77. The system of claim 1, wherein said major diameter is greater than approximately 6 inches.

78. The system of claim 1, wherein said major diameter is greater than approximately 8 inches.

79. The system of claim 1, wherein said major diameter is greater than approximately 12 inches.

80. The system of claim 1, wherein said major diameter is less than approximately 18 inches.

81. The system of claim 1, wherein said major diameter is less than approximately 21 inches.

82. The system of claim 1, wherein said major diameter is less than approximately 24 inches.

83. The system of claim 1, wherein said major diameter is less than approximately 27 inches.

84. The system of claim 1, wherein said major diameter is less than approximately 30 inches.

85. A method for forming a storm water control device comprising:

placing a compost-based filling into a mesh tube formed from a mesh material having a nominal opening size of less than 0.5 inches, a ratio of a length of the mesh tube to a diameter of the mesh tube greater than 40, said mesh tube comprising a first tubular mesh enclosure attached to, and overlapping, a second tubular mesh enclosure; and providing the mesh tube to a location prone to storm-water flow.

86. A method for forming a sediment control device comprising:

placing a compost-based filling into a mesh tube formed from a mesh material having a nominal opening size of less than 0.5 inches, a ratio of a length of the mesh tube to a diameter of the mesh tube greater than 40, said mesh tube comprising a first tubular mesh enclosure attached to, and overlapping, a second tubular mesh enclosure; and providing the mesh tube to a location prone to sediment-containing water flow.

* * * * *